US011344089B2

(12) United States Patent
Cudden

(10) Patent No.: US 11,344,089 B2
(45) **Date of Patent: *May 31, 2022**

(54) REMOVABLE STORAGE POUCH ASSEMBLY

(71) Applicant: Lynne Cudden, Mesa, AZ (US)

(72) Inventor: Lynne Cudden, Mesa, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/331,705

(22) Filed: May 27, 2021

(65) Prior Publication Data

US 2021/0282515 A1 Sep. 16, 2021

Related U.S. Application Data

(63) Continuation-in-part of application No. 17/120,679, filed on Dec. 14, 2020, now Pat. No. 11,266,216, which is a continuation-in-part of application No. 16/362,306, filed on Mar. 22, 2019, now Pat. No. 10,863,805.

(60) Provisional application No. 62/647,138, filed on Mar. 23, 2018.

(51) Int. Cl.

| | |
|---|---|
| ***A45C 7/00*** | (2006.01) |
| ***A45C 13/10*** | (2006.01) |
| ***A45C 15/06*** | (2006.01) |
| ***A45C 13/00*** | (2006.01) |

(52) U.S. Cl.

CPC ..... *A45C 7/0045* (2013.01); *A45C 13/001* (2013.01); *A45C 13/103* (2013.01); *A45C 15/06* (2013.01); *A45C 2200/10* (2013.01)

(58) Field of Classification Search

CPC ... A45C 7/0045; A45C 13/001; A45C 13/103; A45C 15/06; A45C 2200/10

See application file for complete search history.

(56) References Cited

U.S. PATENT DOCUMENTS

| | | | | |
|---|---|---|---|---|
| 5,073,844 | A * | 12/1991 | Coyner | A45C 15/06 362/156 |
| 5,613,756 | A * | 3/1997 | Allen | G09F 13/04 362/103 |
| 5,764,132 | A * | 6/1998 | Hill | G08B 21/0297 340/321 |
| 6,132,059 | A * | 10/2000 | Leibowitz | A45C 15/06 362/154 |
| 10,271,626 | B1 * | 4/2019 | Anderson | A45C 13/008 |
| 2003/0090895 | A1 * | 5/2003 | Guerrieri | H05B 47/165 362/156 |
| 2004/0174702 | A1 | 9/2004 | Guerrieri | |
| 2011/0170282 | A1 * | 7/2011 | Munoz | A45C 15/06 362/156 |
| 2017/0020239 | A1 * | 1/2017 | Cowdery | A44B 19/26 |

(Continued)

*Primary Examiner* — Anabel Ton

(74) *Attorney, Agent, or Firm* — Simonelli IP, PLLC

(57) ABSTRACT

A removable storage pouch includes a pouch having a closeable opening providing access to an inner volume and three pouch attachment points coupled to an exterior side of the pouch. The removable storage pouch also includes a connector assembly having three corresponding pouch attachment points and two surface attachment points. Further, the removable storage pouch includes a removable light assembly operatively coupled to an inner surface of the pouch within the inner volume. A pocket secured to the inner surface of the pouch holds the removable light assembly in a secure position with the light facing the inner volume ensuring a well-lit inner volume.

10 Claims, 16 Drawing Sheets

(56) References Cited

U.S. PATENT DOCUMENTS

2018/0317620 A1* 11/2018 Larson ..... A44B 19/32
2021/0093061 A1* 4/2021 Cudden ..... A45C 13/02

* cited by examiner

REMOVABLE STORAGE POUCH ASSEMBLY

This application is a continuation-in-part of U.S. Patent Application entitled "REMOVABLE STORAGE POUCH ASSEMBLY," application Ser. No. 17/120,679, filed Dec. 14, 2020, which is a continuation-in-part of U.S. Patent Application entitled "REMOVABLE STORAGE POUCH ASSEMBLY," application Ser. No. 16/362,306, filed Mar. 22, 2019, which claims priority to U.S. Provisional Patent Application to Lynne Cudden entitled "REMOVABLE STORAGE POUCH," application Ser. No. 62/647,138, filed Mar. 23, 2018, the disclosures of which are hereby incorporated entirely herein by reference.

BACKGROUND OF THE INVENTION

1. Field of the Invention

This invention relates generally to a pouch and more particularly to a removable storage pouch assembly that is attachable and detachable to another surface, such as, but not limited to, an interior surface of a bag or purse.

2. Description of the Related Art

A conventional pouch for use with a bag, such as a purse, is typically placed loosely within the bag. The user then needs to search for the pouch within the bag in order to locate and utilize the pouch. The pouch is generally not readily available, making the usage of such a pouch ineffective regarding ease of access and use.

SUMMARY OF THE INVENTION

A pouch assembly includes a body having a closeable opening that defines first and second edges. The opening provides access to an inner volume defined by a front side and a back side. A light unit has a power source. The light unit creates light. A pocket is secured to the body within the inner volume to hold the light unit in place against one of the front and back sides, such that the light created by the light unit illuminates the inner volume of the body.

The foregoing and other features and advantages will be apparent from the following more detailed description of the particular embodiments of the invention, as illustrated in the accompanying drawings.

BRIEF DESCRIPTION OF THE DRAWINGS

A more complete understanding of the embodiments disclosed herein may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
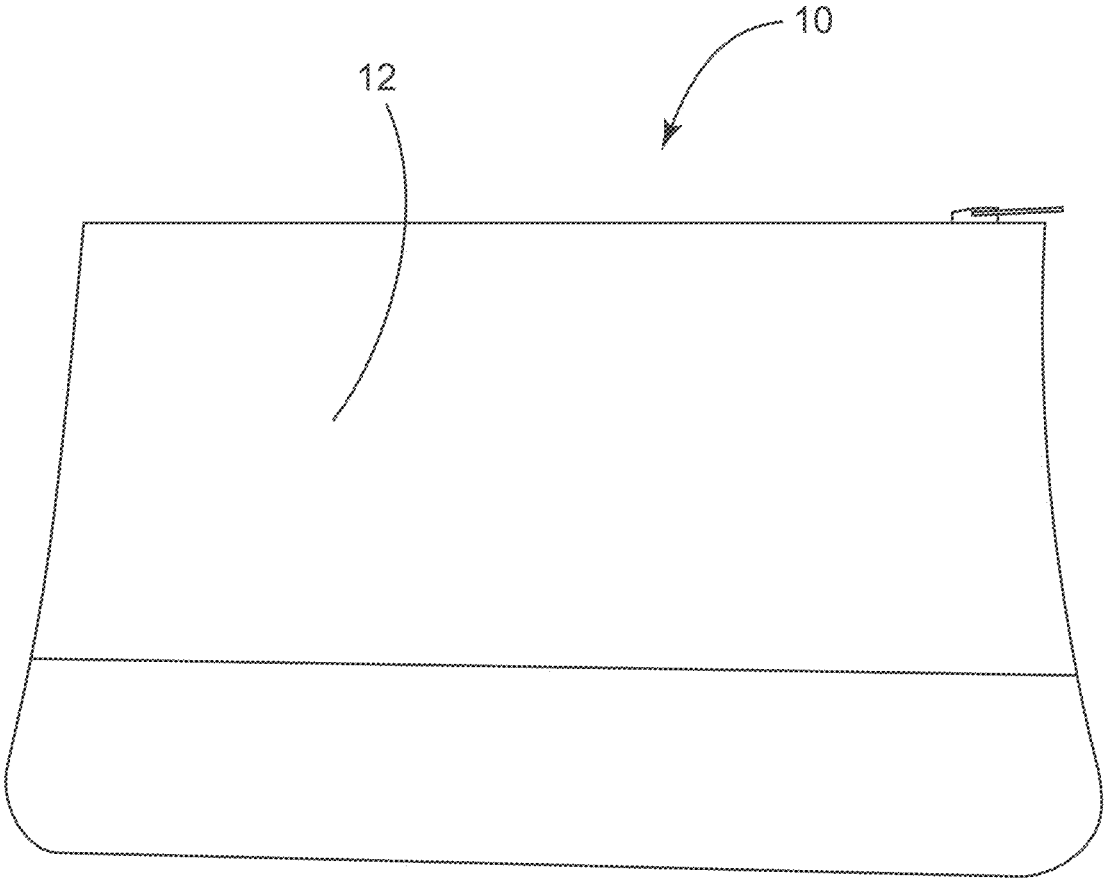
FIG. 1 is a front view of a removable storage pouch in accordance with an embodiment.
Figure 2:
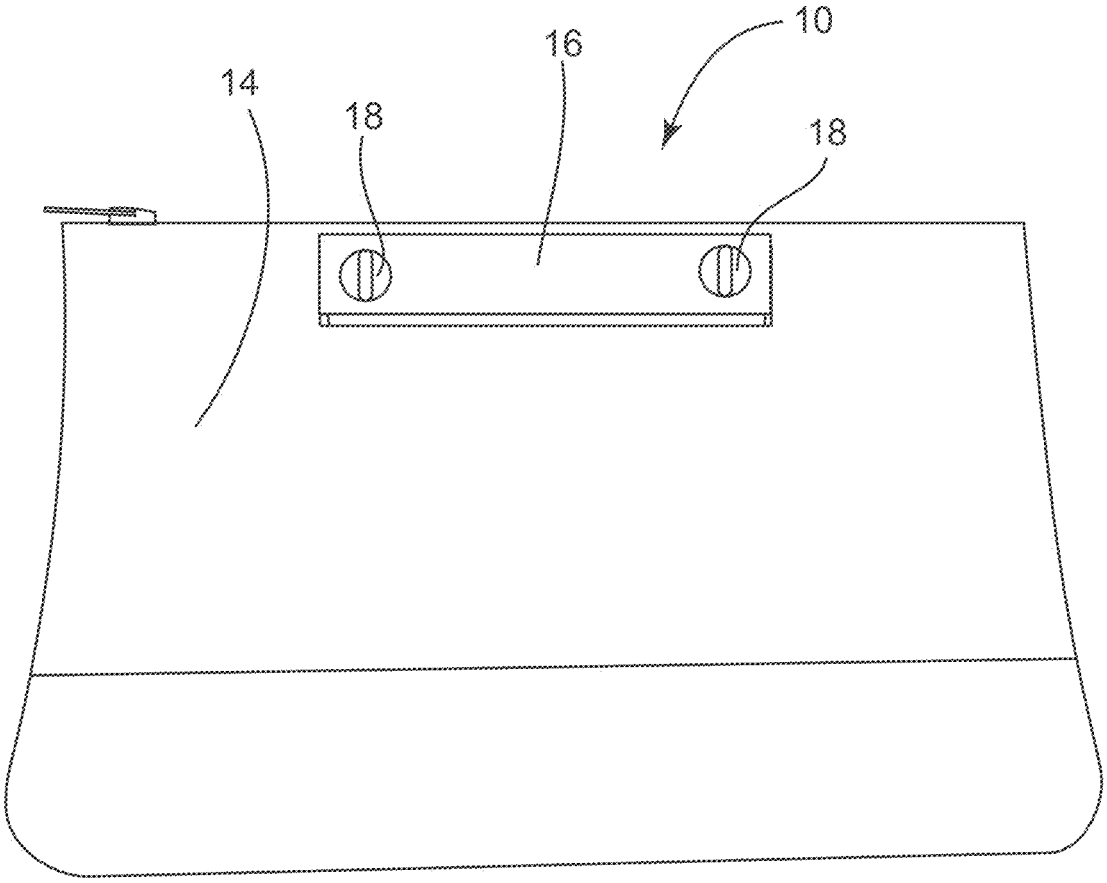
FIG. 2 is a rear view of a removable storage pouch in accordance with an embodiment.
Figure 3:
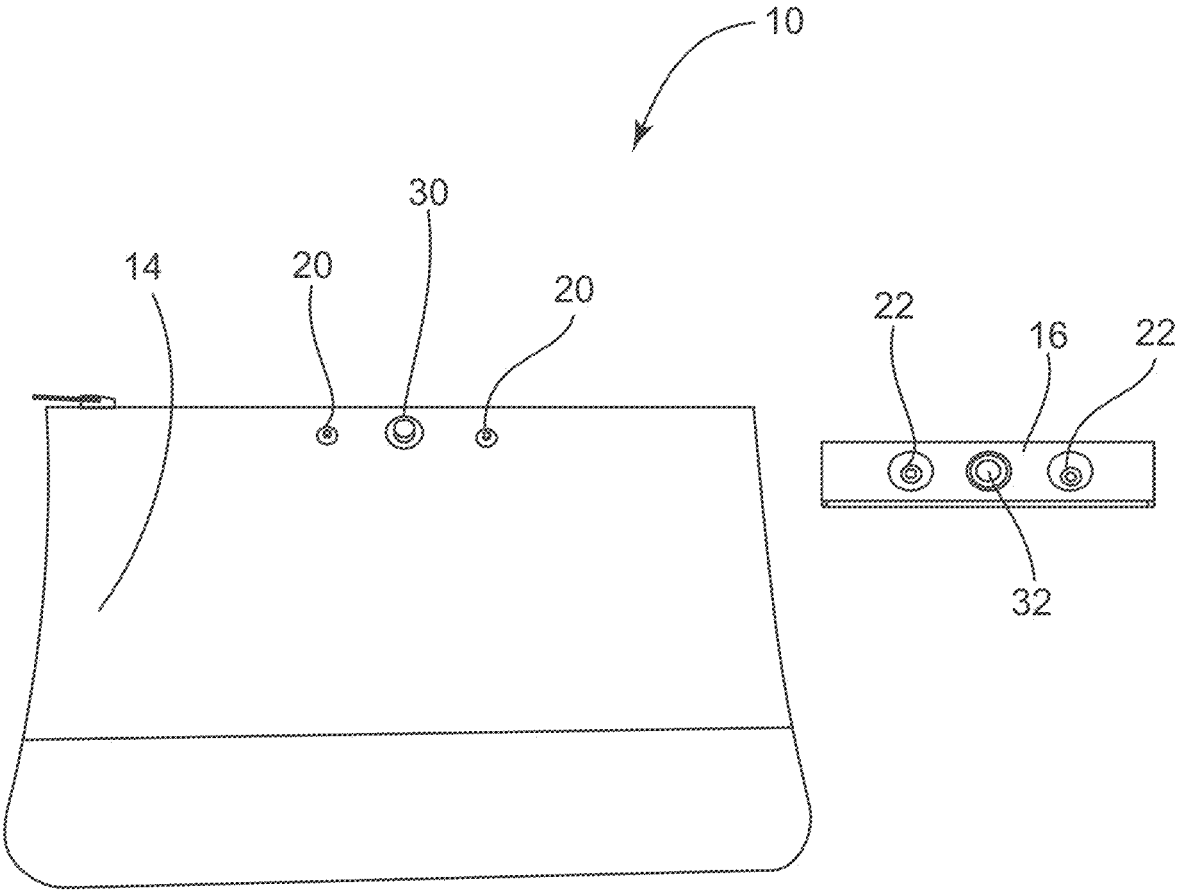
FIG. 3 is an exploded view of a removable storage pouch in accordance with an embodiment.
Figure 4:
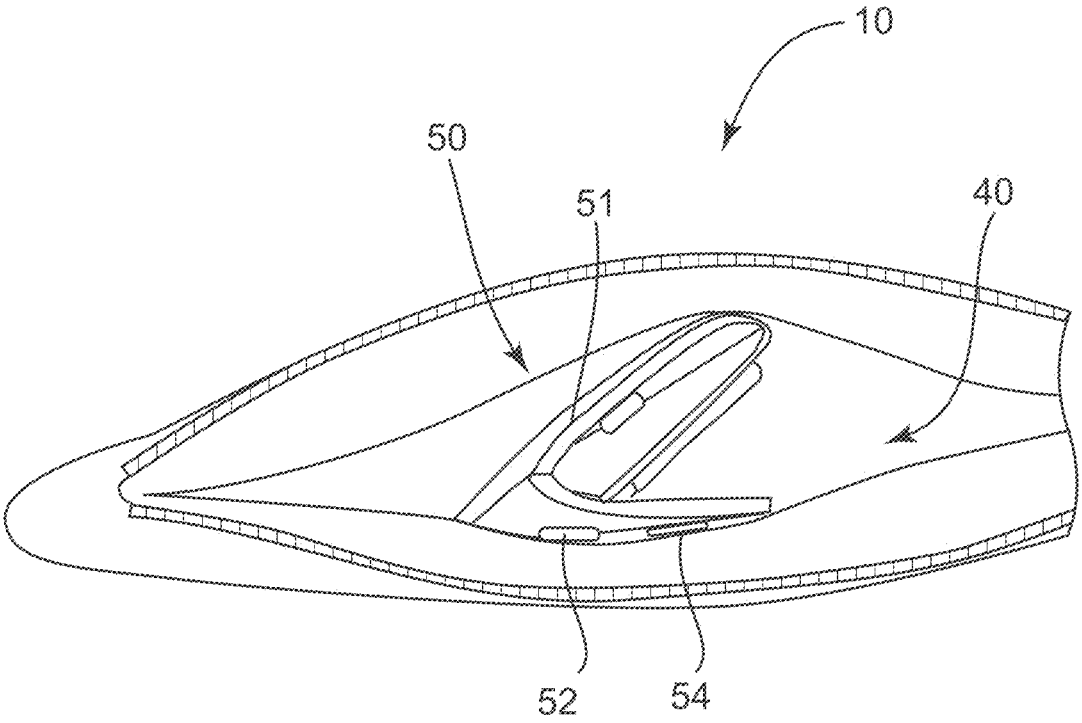
FIG. 4 is a perspective view of a removable storage pouch in an open position and light source unlit in accordance with an embodiment.
Figure 5:
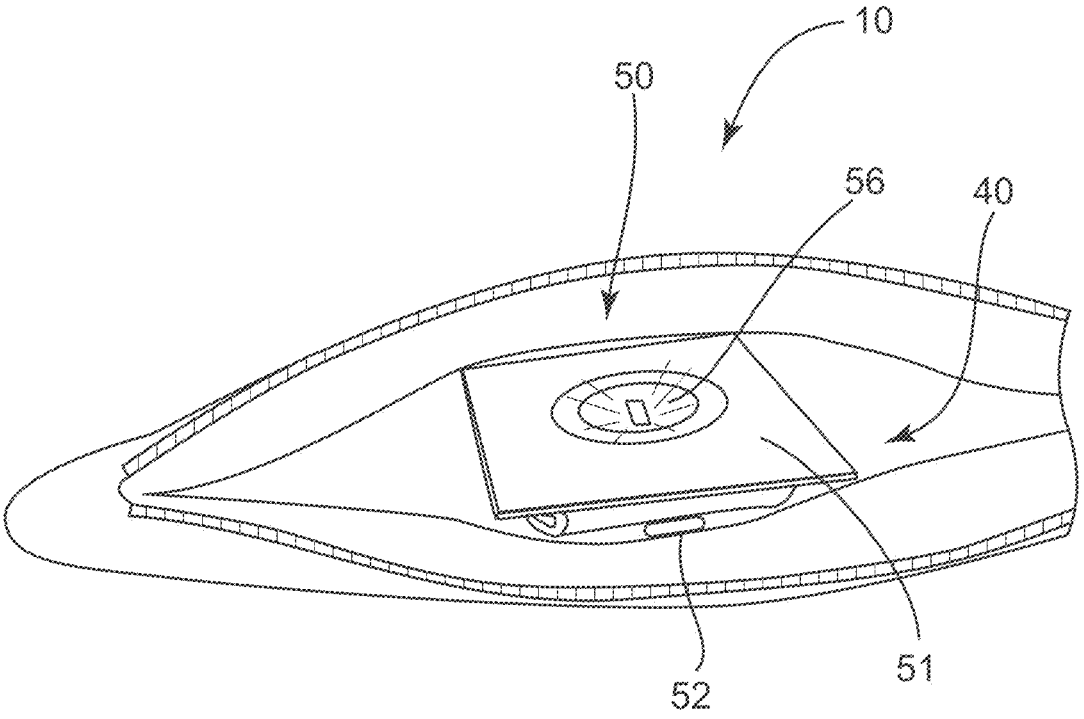
FIG. 5 is a perspective view of a removable storage pouch in an open position and light source lit in accordance with an embodiment.
Figure 6:
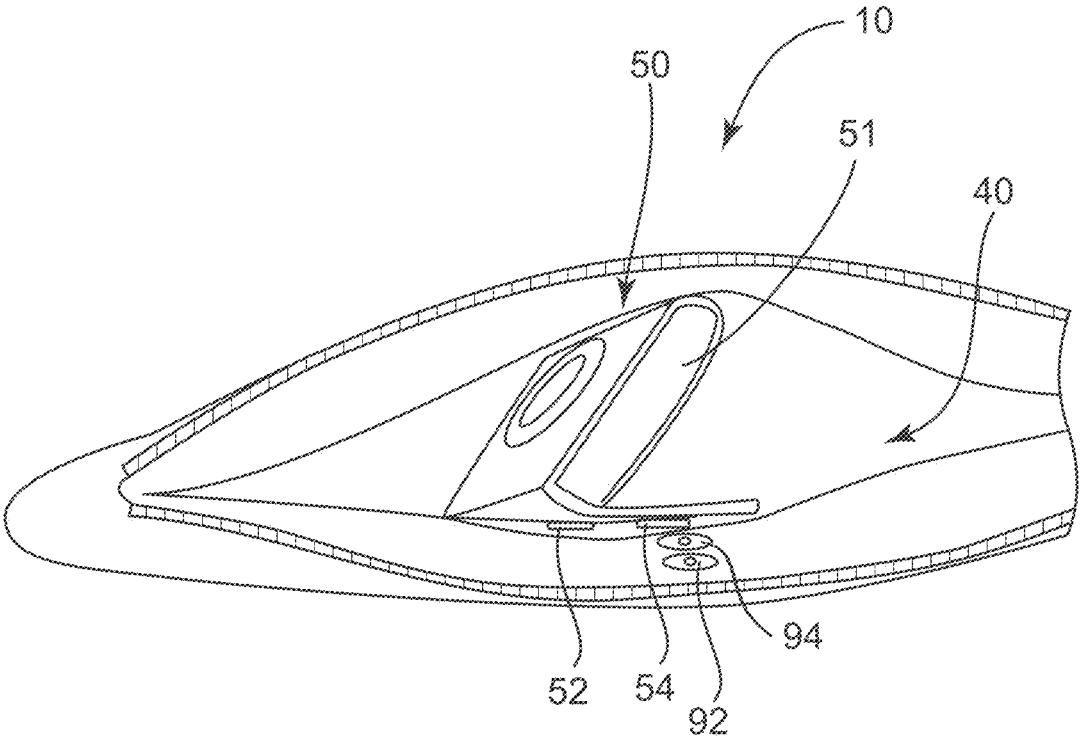
FIG. 6 is a perspective view of a removable storage pouch in an open position and light source unlit in accordance with an embodiment.

As discussed above, embodiments are shown relating to a removable storage pouch assembly with a light source. The removable storage pouch assembly is for use with another surface, such as, but not limited to, an interior surface of a bag or purse.

Referring to FIGS. 1 through 10, a removable pouch assembly may include a small pouch 10, a connection member 16, and a light assembly 50. The pouch 10 includes a front side 12, a back side 14. The connection member 16 securely connects the pouch 10 to a surface for the purpose of adding small, convenient, removable storage, and with the connection member 16 permitting the easy separation of the pouch 10 from where it is connected.

The pouch 10 includes a plurality of attachment points 20, 30 affixed by any means to a surface of the pouch 10, such as to the exterior of the back surface 14 of the pouch 10. In embodiments, the back surface 14 may be of a stiff material to provide support for the attachment points 20, 30. These attachment points 20, 30 include one side of a pouch joint by which the pouch 10 connects to the pouch joint on the inboard side of a connector assembly 16, on which is affixed the corresponding attachment points 22, 32 for the pouch joint. The outboard side of the connector assembly 16 includes further attachment points 18 that comprise one side of a joint for the attachment of the connector assembly 16 and pouch to a surface, such as a bag, a purse, a case, or a pack, for example. The attachment points 18 comprising the other side of the joint are configured to be affixed to the surface to which the pouch 10 is to be attached.

With each of the above joints fully engaged, the pouch 10 is solidly affixed to a surface but can be easily removed by unsnapping the attachment points 20, 30 of the pouch joint, thus separating the pouch 10 from the connector assembly 16 which remains securely affixed to the surface. The pouch 10 can once again be securely attached to the surface simply by re-engaging the attachment points 20, 30 to the corresponding attachment points 32 and 22.

In an embodiment of the invention, male/female snaps 30 and 32 and 20 and 22 are used as the attachment points for the pouch joint with two of the snaps (20 and 22) composed of electrically conductive material and forming a portion of an electrical circuit. Furthermore, within the connector assembly 16, the two attachment points 32 are connected via an electrically conductive material, such as by electrical wire, for example. This electrical circuit additionally includes a pair of electrically conductive attachment member that comprises one side of an electrically conductive accessory attachment joint on the interior surface of the pouch 10. The opposite conductive attachment member for the accessory attachment joint are integral components 52 and 54 of a light assembly 50, which includes any number of light sources 56 connected to a small power source (not shown). The power and light sources 56 are located within a flexible housing 51 that includes the electrically conductive attachment member 52 and 54.

Figure 7:
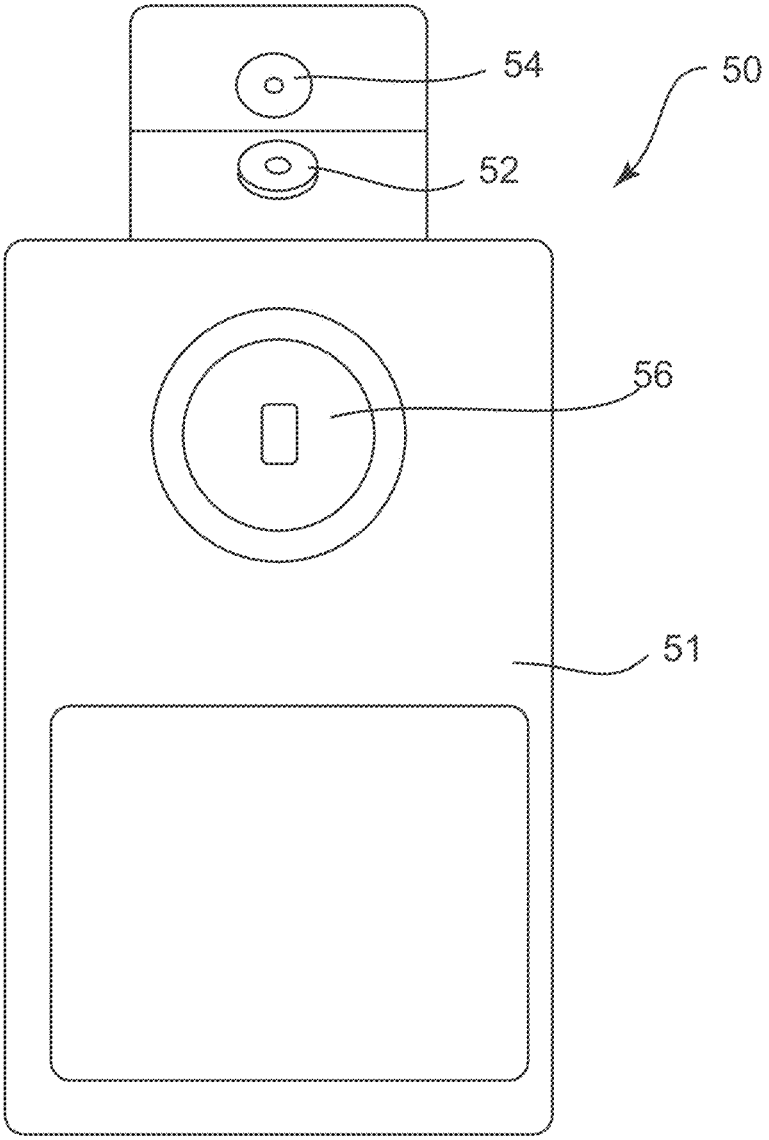
FIG. 7 is a front view of a light source unlit in accordance with an embodiment.
Figure 8:
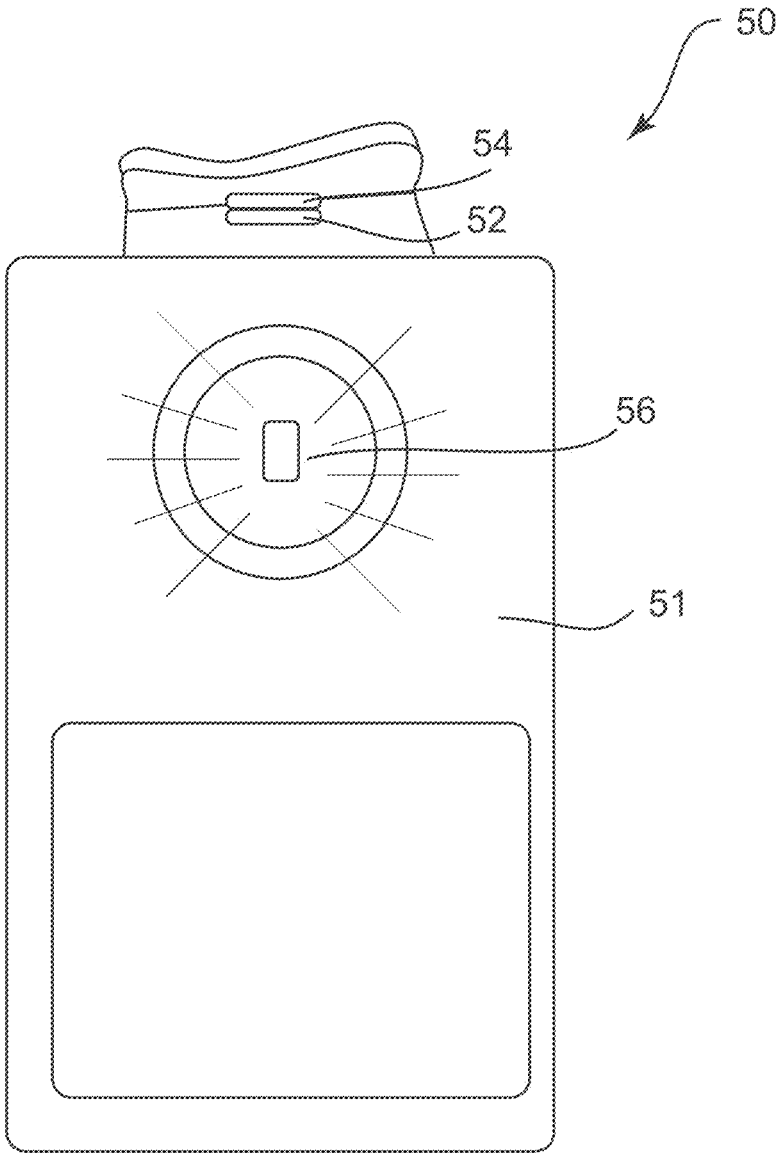
FIG. 8 is a front view of a light source lit in accordance with an embodiment.

When the pouch 10 is affixed to a surface and the light assembly 50 is connected to the pouch 10 via the accessory attachment joint an electrical circuit is formed from the power source (not shown), through the light source(s) 56, into the connector assembly via the first attachment member 52 of the accessory attachment joint, through a first set of attachment points 20 and 22, across the portion of the circuit portion in the connector assembly 16 to the second set of attachment points 22 and 20, and back to the power source via the second attachment member 54 of the accessory attachment joint. Thus, a closed circuit is formed with the light assembly 50 providing light to the pouch 10 interior and surrounding area. This circuit can be broken by unfixing any of the attachment member 52 or 54 or by a switch placed at a convenient location along the electrical circuit. In additional embodiments, as shown in FIGS. 7 and 8, the first attachment member 52 may be a female attachment member and the second attachment member 54 may be male attachments that can be coupled together to close a circuit and operate the light source 56 in conditions when the light assembly 50 is removed from within the pouch 10. This allows for external uses of the light assembly 50.

Figure 9:
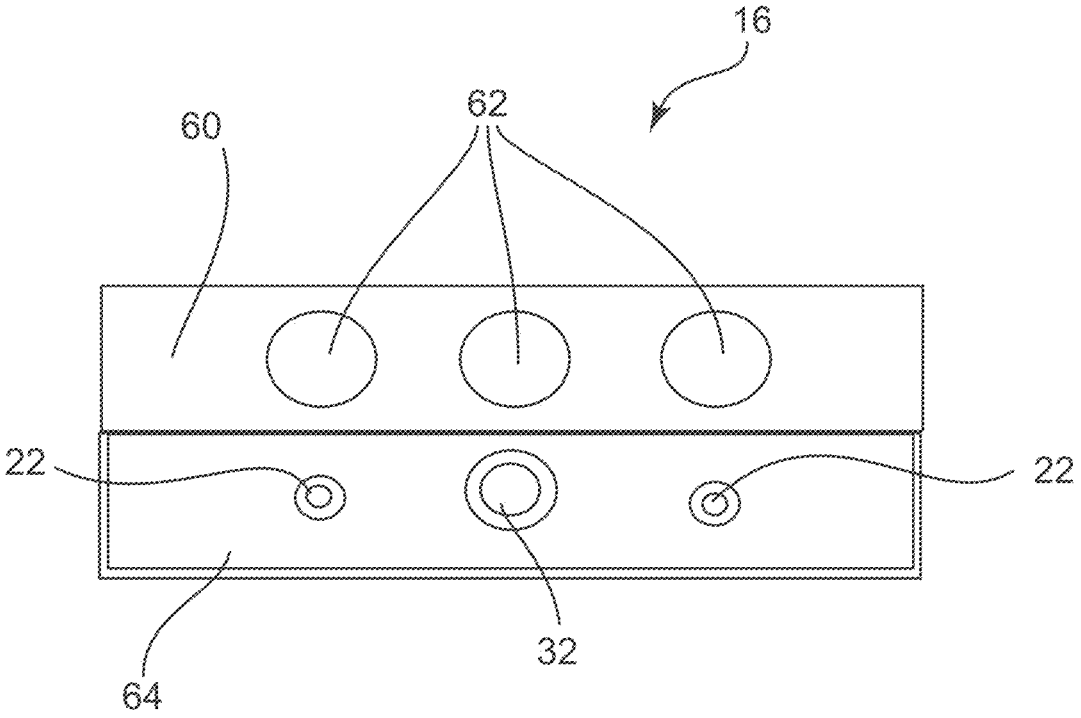
FIG. 9 is a perspective view of a connector assembly in accordance with an embodiment.
Figure 10:
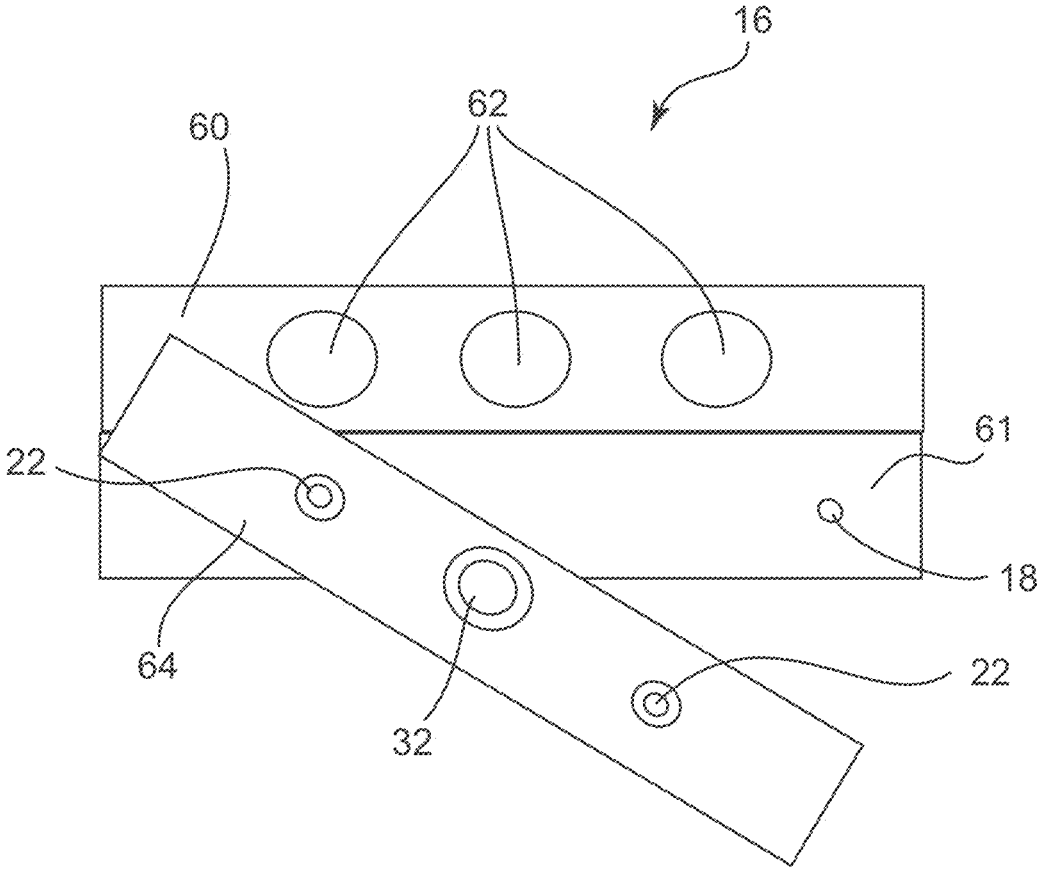
FIG. 10 is another perspective view of a connector assembly in accordance with an embodiment.

Referring specifically to FIGS. 9 and 10, the connector assembly 16 may include a folding member having a first portion 60 with apertures 62 extending through the first portion 60 and a second portion 61 having attachment points 18 for securing the folding member to a surface. The first portion 60 may be releasably coupled to the second portion 61 such as by use of a hook-and-loop fastener. The first portion 60 may be released and rotated away from the second portion 61 exposes and allows for removal of inner member 64, to which attachment points 32 and 22 are coupled to the inner member 64. The attachment points 32 and 22 are coupled to the inner member 64 in a position corresponding to the apertures 62 of the first portion 60 such that when the first portion 60 is coupled to the second portion 61 the attachment points 32 and 22 are exposed and have the ability to be secured to a pouch 10 as described above. This allows multiple folding members to be coupled to different surfaces, such as, but not limited to, different bags and using a single inner member 64 to be utilized with the multiple folding members. It will be appreciated that while FIGS. 9 and 10 depict a connector assembly 16 that includes a folding member having a first portion 60 and a second portion 61, some embodiments do not include a folding member. Embodiments that do not have a folding member may include the inner member 64 coupled to another member or material similar to the first portion 60 without a second portion 62 to fold over the inner member 64. In this embodiment the connector assembly 16 functions as intended.

Figure 11A:
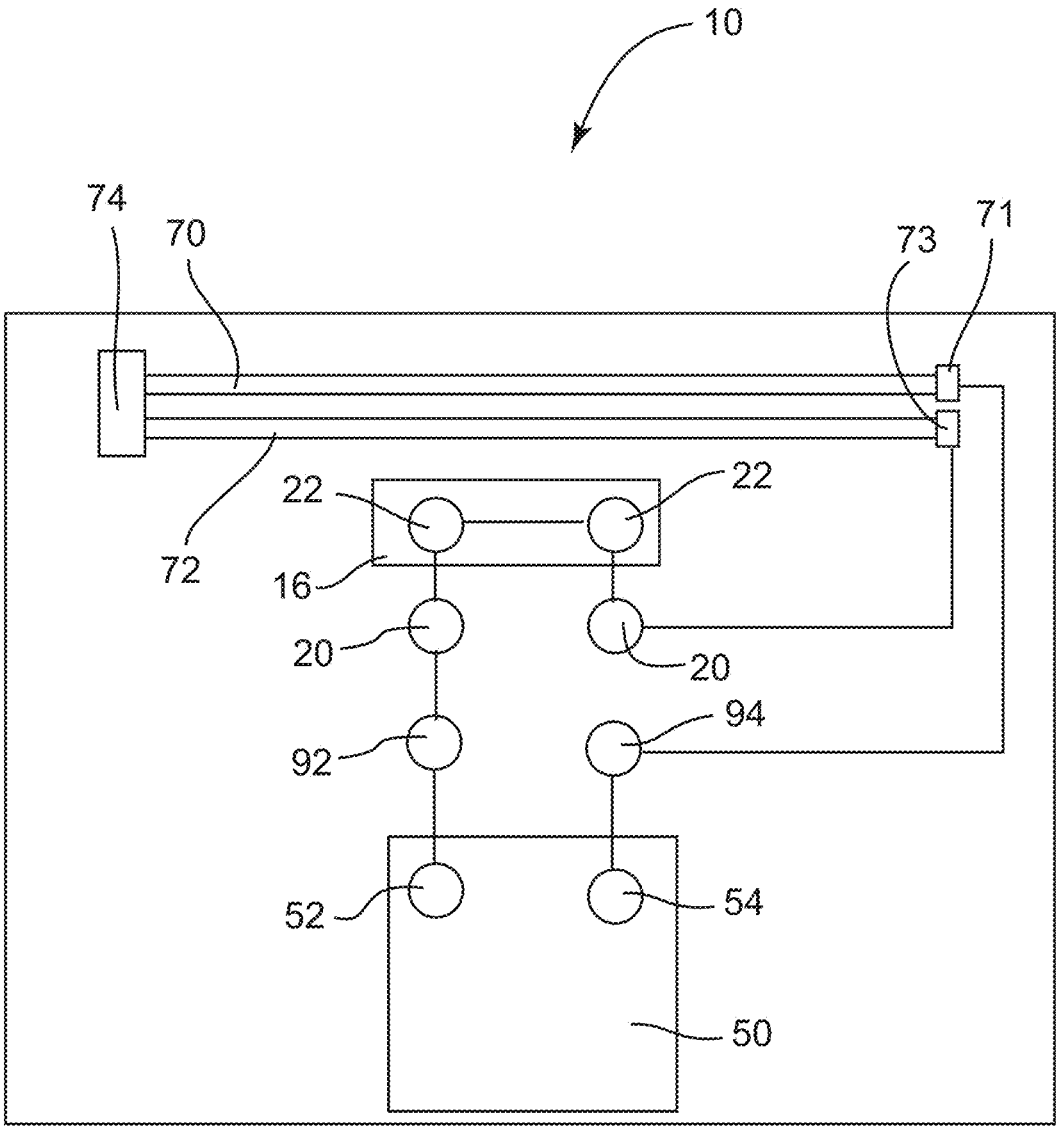
FIG. 11A is a schematic view of a removable storage pouch with a zipper closed in accordance with an embodiment.
Figure 11B:
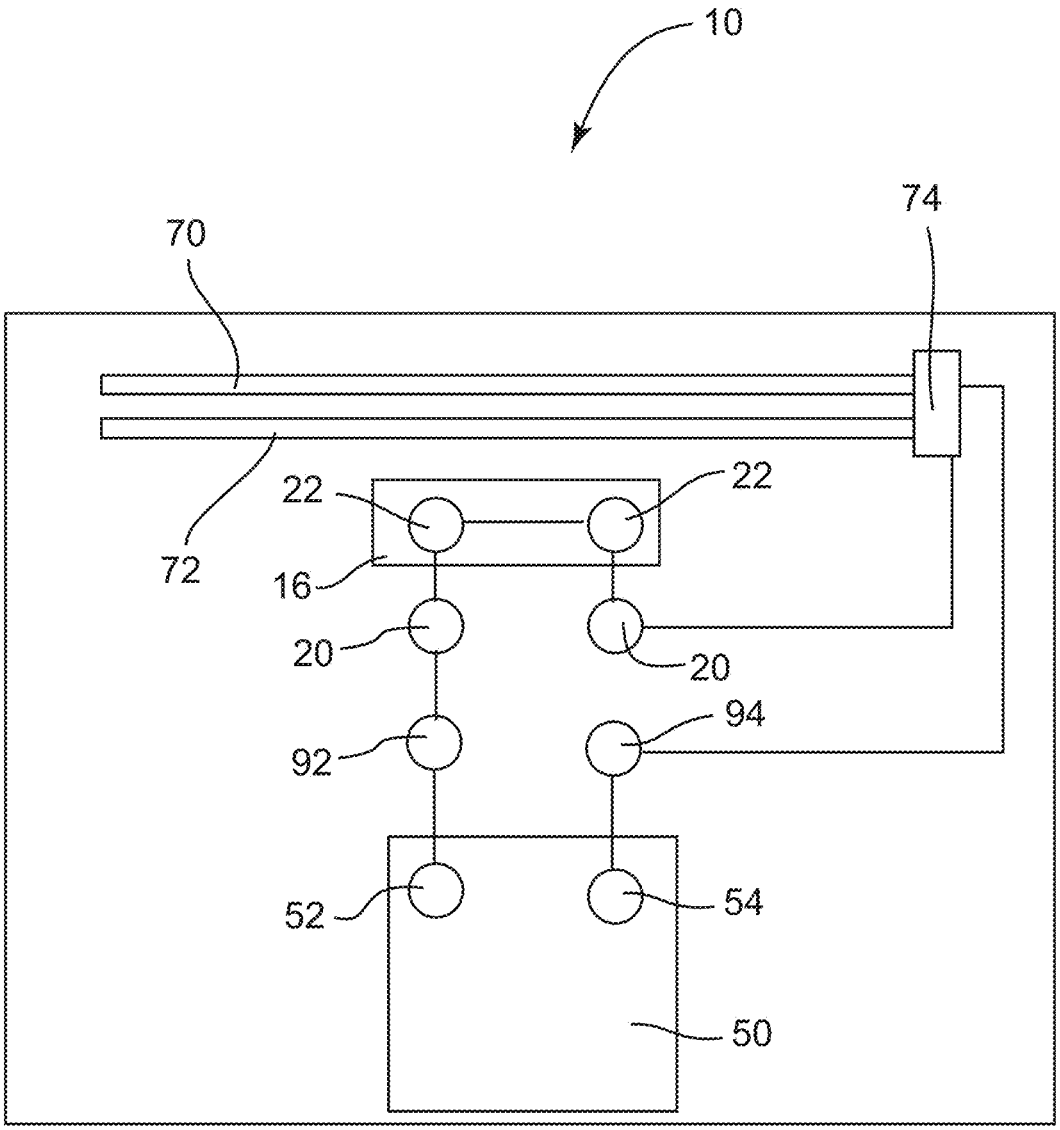
FIG. 11B is a schematic view of a removable storage pouch with a zipper opened in accordance with an embodiment.
Figure 12:
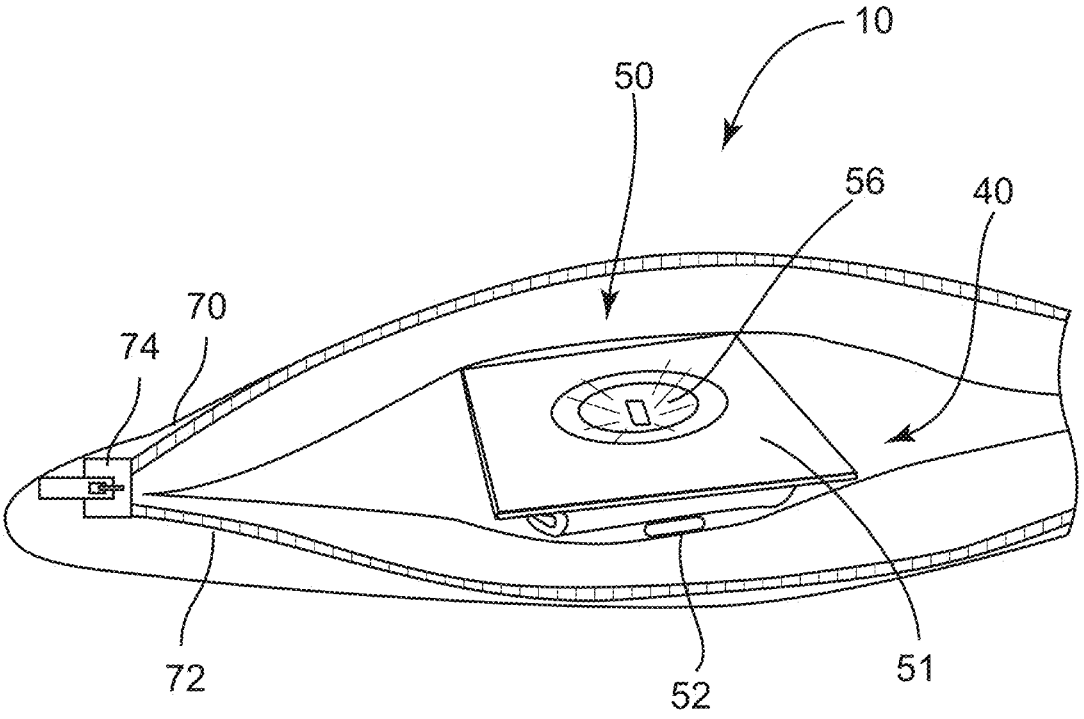
FIG. 12 is a perspective view of a removable storage pouch in an open position and light source lit in accordance with an embodiment.

Referring to the drawings, FIGS. 11A through 12 depict another embodiment. The pouch 10 may include attachment points 20 and 22 composed of electrically conductive material, such as electrical wire or conductive thread or the like, and forming a portion of an electrical circuit, and conductive connectors 92 and 94 (See FIGS. 6 and 11A).

Conductive connector 94 may be coupled to a first zipper tape 70 with a first conductive connection member 71 and one attachment point 22 may be coupled to a second zipper member 72 with a second conductive connection member 73 (See FIG. 11A). A metal zipper pull 74 may be coupled to the zipper, where conductive connection members 71 and 73 on the first and second zipper tapes 70 and 72, respectively, are simultaneously contacted by the metal zipper pull 74 when the zipper pull 74 completely unzips the zipper of the pouch 10 (See FIG. 11B).

Therefore, integral components 52 and 54 of a light assembly 50, which includes any number of light sources 56, are connected to a small power source (not shown). The power and light sources 56 are located within a flexible housing that includes the electrically conductive attachment member 52 and 54. When the light assembly 50 is connected to the pouch 10 via a first and second conductive connectors 92 and 94, an electrical circuit is formed from the power source (not shown) to power and illuminate the light source(s) 56. The circuit includes the conductive attachment member 52 coupled to the first conductive connector 92 that is coupled to the attachment point 20 through conductor 64 (which is usually covered by the decorative connection member 16), which is coupled to attachment point 22 and attachment point 22 is coupled to the second conductive connection member 73 coupled to the second zipper tape 72. The circuit further includes conductive attachment member 54 coupled to the second conductive connector 94, which is coupled to the first conductive connection member 71 coupled to the first zipper tape 70. The circuit is completed with the metal zipper pull contacting the first and second conductive connection members 71, 73. This illuminated the light source(s) 56. Thus, a closed circuit is formed with the light assembly 50 providing light to the pouch 10 interior and surrounding area when the zipper pull 74 is pulled to a fully opened position. This circuit can be broken by unfixing any of the attachment member 52 or 54 or by pulling the zipper pull 74 toward a closed position.

Figure 13:
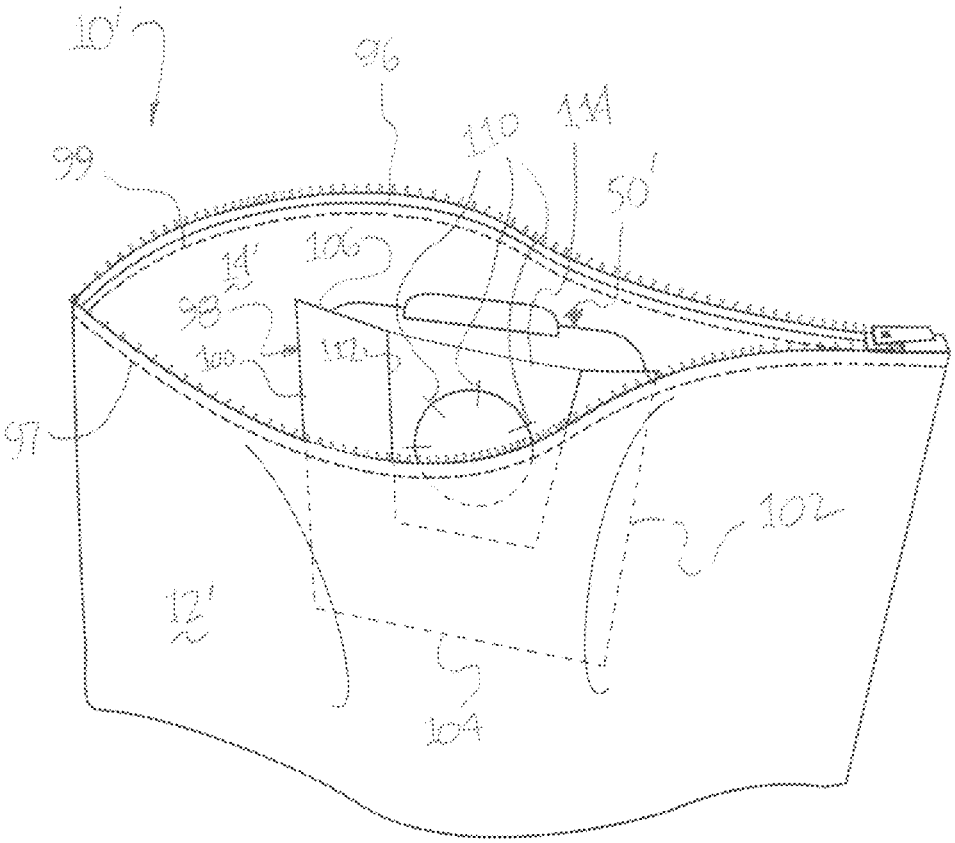
FIG. 13 is a perspective view of an open pouch with one embodiment of a pocket and a light source stored therein.
Figure 14:
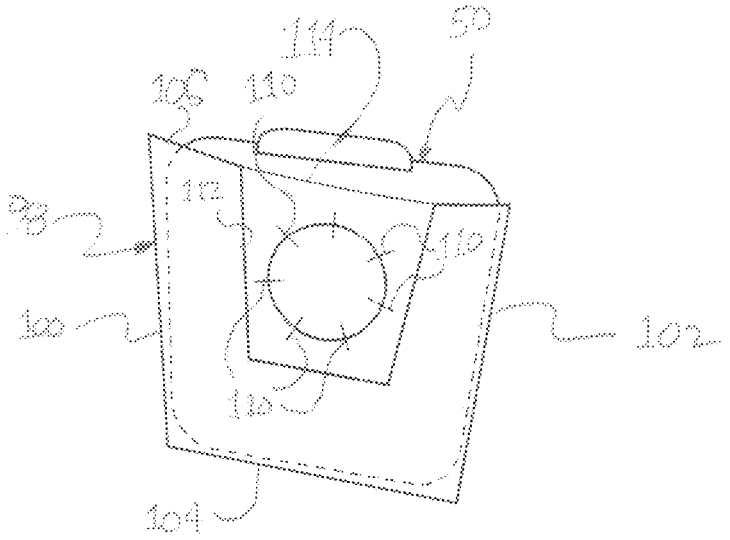
FIG. 14 is a perspective view of the pocket with a light source stored therein.
Figure 15:
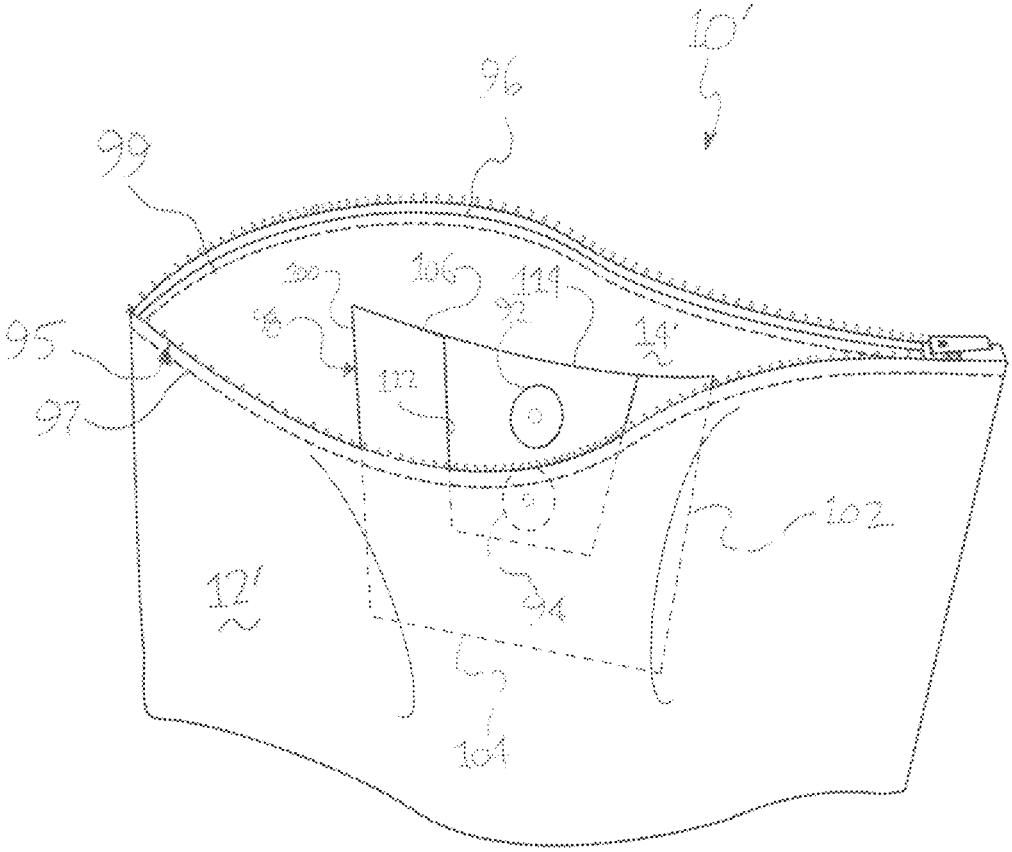
FIG. 15 is a perspective view of the open pouch of FIG. 13 with the light source removed.

Referring to FIGS. 13 through 15, wherein like primed numeral represent similar elements to those disclosed above, the pouch assembly 10' is similar to the embodiments shown above. The pouch assembly 10' includes the front side 12' and the back side 14'. The pouch assembly 10' also defines an opening, generally shown at 95, providing access to the interior of the pouch assembly 10'. The opening 95 defines a first edge and a second edge, graphically represented by stitching 97, 99, respectively. An interior back surface 96 (a part of back side 14 discussed above) includes a pocket, generally shown at 98, attached thereto. The pocket 98 is secured to the interior back side 96 along two side edges 100, 102 and a bottom edge 104. The edges 100, 102, 104 may been sewn, glued or otherwise affixed to the interior back side 96 of the pouch 10' using a method known in the art.

A top edge 106 of the pocket 98 is not secured to the interior back side 96. The top edge 106 extends between the two side edges 100, 102. The top edge 106 is free to allow the light assembly 50' to be inserted therein. The pocket 98 holds the light assembly 50' in place in a manner that maximizes the light (represented by lines of light 110) being emitted into the interior of the pouch 10'. The pocket 98 also holds the light assembly 50' in a manner that prevents the light assembly 50' from being inadvertently disconnected from the conductive connectors 92, 94.

The pocket 98 may define a cut-out 112. The cut-out 112 extends down from the top edge 106 toward the bottom edge 104. The cut-out 112 does not extend all the way to the bottom edge 104 or the two side edges 100, 102. The cut-out 112 may be void of material. Alternatively, and as shown in FIGS. 13 through 15, a piece of material 114 extend over the cut-out 112. The piece of material 114 is either translucent or transparent to allow the light 110 to pass therethrough and into the pouch 10'.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed.

Many modifications and variations are possible in light of the teachings above without departing from the spirit and scope of the forthcoming claims.

I claim:

1. A pouch assembly, comprising:

a body having a closeable opening defining first and second edges, said opening providing access to an inner volume thereof;

first and second pouch attachment points made of an electrically conductive material;

a first zipper tape extending along said first edge;

a second zipper tape extending along said second edge;

a first conductive connection member coupled to said first zipper tape;

a second conductive connection member coupled to said second zipper tape and electrically coupled to the second pouch attachment point;

a first conductive connector coupled to a first pouch attachment point;

a second conductive connector electrically coupled to the second conductive connection member;

a zipper pull coupled to the first and second zipper tapes;

a connector including two inner member attachment points made of electrically conductive material and electrically coupled to each other, wherein said connector is coupled to said body and thereby couples said first pouch attachment point to one of said inner member attachment point and said second pouch attachment point to the other of said inner member attachment point;

a light unit having a housing and a power source;

at least one light electrically coupled to said power source;

a first electrically conductive attachment member coupled to said housing, said first electrically conductive attachment member being electrically coupled to said light unit;

a second electrically-conductive attachment member coupled to said housing, said second electrically-conductive attachment member being electrically coupled to said power source, wherein said first electrically-conductive attachment member is coupled to said first conductive connector and said second electrically-conductive attachment member is coupled to said second conductive connector within said body, thereby completing an electrical circuit when said zipper pull unzips said first and second zipper tapes and contacts said first and second conductive connection members simultaneously to illuminate said light unit; and a pocket secured to said body within said inner volume to hold said light unit in place with respect to said inner volume of said body.

2. A pouch assembly as set forth in claim 1 wherein said pocket includes a cut-out allowing light produced by said light unit to be transmitted past said pocket and into said inner volume of said body.

3. A pouch assembly as set forth in claim 2 including a piece of material covering said cut-out.

4. A pouch assembly as set forth in claim 3 wherein said piece of material is transparent.

5. A pouch assembly as set forth in claim 3 wherein said piece of material is translucent.

6. A pouch assembly as set forth in claim 3 wherein said pocket covers said first and second conductive connectors.

7. A pouch assembly, comprising:

a body having a closeable opening defining first and second edges, said opening providing access to an inner volume defined by a front side and a back side;

a light unit having a power source, said light unit creating light; and a pocket secured to said body within said inner volume to hold said light unit in place against one of said front and back sides, said pocket including a cut-out such that the light created by said light unit is transmitted past said pocket and into said inner volume of said body illuminating said inner volume of said body.

8. A pouch assembly as set forth in claim 7 including a piece of material covering said cut-out.

9. A pouch assembly as set forth in claim 8 wherein said piece of material is transparent.

10. A pouch assembly as set forth in claim 8 wherein said piece of material is translucent.

* * * * *